US008789810B2

(12) United States Patent
Weinreich

(10) Patent No.: US 8,789,810 B2
(45) Date of Patent: Jul. 29, 2014

(54) DECKING AND PLANK REMOVAL TOOL

(76) Inventor: Benjamin Weinreich, Sykesville, MD (US)

( * ) Notice: Subject to any disclaimer, the term of this patent is extended or adjusted under 35 U.S.C. 154(b) by 0 days.

(21) Appl. No.: 13/493,459

(22) Filed: Jun. 11, 2012

(65) Prior Publication Data

US 2012/0313060 A1 Dec. 13, 2012

Related U.S. Application Data

(60) Provisional application No. 61/495,885, filed on Jun. 10, 2011.

(51) Int. Cl.
*B66F 3/00* (2006.01)

(52) U.S. Cl.
USPC ..... 254/131; 254/131.5

(58) Field of Classification Search
USPC ..... 254/131, 131.5
See application file for complete search history.

(56) References Cited

U.S. PATENT DOCUMENTS

D153,042 S * 3/1949 Sennewald ..... D8/88
2,896,910 A * 7/1959 Cooper et al. ..... 254/131
3,035,815 A * 5/1962 Sparks ..... 254/129
D277,359 S * 1/1985 Schiller ..... D8/89
5,447,289 A * 9/1995 Callahan ..... 254/131

OTHER PUBLICATIONS

Duckbill Deck wrecker—instructions manual (downloaded from http://www.deckwrecker.com/instructions.html) (website last visited Sep. 10, 2012).
CatsPaw Deck Wrecker—product description (downloaded from http://www.amazon.com/Mayhew-Tools-41104-CastPaw-Wrecker/dp/B001S2QR1A) (website last visited Sep. 10, 2012) and product description (downloaded from http://toolmonger.com/2009/07/08/catspaw-deck-wrecker/) (website last visited Sep. 10, 2012).
Duck Prybar—product description (http://www.duckprybar.com) (website last visited Sep. 10, 2012).

* cited by examiner

*Primary Examiner* — Lee D Wilson
*Assistant Examiner* — Shantese McDonald
(74) *Attorney, Agent, or Firm* — Ober, Kaler, Grimes & Shriver; Royal W. Craig

(57) ABSTRACT

A versatile lever-type decking and plank removal tool for more efficiently prying floor-boards from deck foundations and floor-joists to which they are nailed. The decking and plank removal tool uses an offset inverted hook to tear off any deckboard in any configuration in seconds with a minimum of effort, allowing the user to remain completely upright for the entire process.

19 Claims, 3 Drawing Sheets

DECKING AND PLANK REMOVAL TOOL

CROSS-REFERENCE TO RELATED APPLICATION

The present application derives priority from U.S. provisional application Ser. No. 61/495,885 filed 10 Jun. 2011.

BACKGROUND OF THE INVENTION

1. Field of the Invention

The present invention relates generally to demolition tools and more particularly, to a versatile one-piece decking and plank removal tool of simple, inexpensive and extremely rugged construction for efficiently prying floor-boards from deck foundations and floor-joists to which they are nailed.

2. Description of the Background

Outdoor decks comprise a series of deck boards nailed side-by-side atop a foundation of deck joists. The deck boards are attached to the joist by long (3") nails which have been driven through the boards into the joists. From time to time it is necessary to replace some or all of the deck boards which deteriorate, and, after several re-decking cycles, the entire deck structure itself. This entails removing the deck rails and prying up the nailed-down deck boards. Most weekend warriors use a crowbar to pry up the deck boards. The flat blade of the crowbar slides down between deck boards and the user levers each board off the foundation. Unfortunately crow bars have a small and narrow blade, and require gradual working from one end of the deck board toward the other. This can take hours and, if for that reason alone, is entirely unsuitable for demolition professionals.

There are a variety of specially-designed deck board removal tools, but most are simply longer or more robust pry bars or wrecking bars. Like crowbars, such tools are long levers which multiply the force applied to the tool handle in order to lever each board off the foundation. There are a number of disadvantages inherent in these designs.

A main disadvantage with pry bars and crowbars is that they are too small, short and fragile, leaving users unable to generate the leverage necessary for the prying operation. Users often resort to pounding the pry bars with a sledgehammer which is a dangerous proposition at best. Moreover, inadequate pry bars are prone to breakage.

Another glaring disadvantage of pry bars and crowbars is that each deck board to be removed requires a fixed adjacent board for leverage. The pry bar must be driven between the deck boards in order to begin the prying operation. Then during the prying operation the deck board being removed tends to butt against the adjacent board, finding reinforcement and requiring more effort on the part of the worker. Also, the wood decking compresses so much due to these non-ideal mechanics and often weathered condition so as to make the crowbar wholly ineffective as it completes its range of motion, sometimes before even a single nail has been dislodged. The net result is a more difficult and time-consuming job, and undue damage to the joists and the deck boards being removed.

Another disadvantage of conventional pry bars is that they frequently do not provide a removal force directly along the axis of the nails during the prying operation, and then transfer all of the force directly to the next fastener in sequence as each fastener fails. Trying to pull the deck boards against the nails causes the deck boards to shatter. Moreover, most pry bars do not provide sufficient leverage during the prying operation to fully dislodge the nails from the foundation. Consequently, a user must pry the board partially loose, then reinsert the pry bar, then pry again, three or four iterations, all of which consumes time, and is less than ideal.

Moreover nearly all other specialty decking removal devices require the handle to travel toward and sometimes over the section of decking that has already been removed. This requires the user's body to be in a perilous place or requires the user to propel their mass towards the areas with removed flooring. There is a need for a decking and plank removal device that allows the user to operate exclusively from the still decked section and allow the user to utilize a pulling motion towards the same. This procedure substantially reduces the hazard exposure to the user and will simplify and expedite the removal of deck boards while minimizing damage to both the deck boards and the joists to which they are attached.

Another disadvantage of most other methods is the requirement to spend a substantial amount of the actual demolition operation from the exposed joists. This presents self-evident hazards as the joists are basically a row of balance beams with protruding rusty nail heads, as a percentage of the nails remain embedded in joists after the deck surface board is torn off.

SUMMARY OF THE INVENTION

It is, therefore, a primary object of the present invention to provide a decking and plank removal tool to simplify and expedite the removal of deck boards, thereby saving time and labor during deck demolition, or demolition of docks or flooring.

It is another object to provide a decking and plank removal tool that pulls the far edge of the deck board straight upward, so that the removal force is directed along the axis of the nails during the prying operation.

It is another object to provide a decking and plank removal tool that provides maximum leverage, capable of exceeding a one-ton removal force directed along the axis of each fastener sequentially during the prying operation.

It is another object to provide a decking and plank removal tool of such rugged construction that it will never break, rust or rot during normal use, or even abnormal misuse.

It is another object to provide a decking and plank removal tool that minimizes damages to deck boards, existing joist and other decking material, allowing re-use it if is desired.

It is another object to allow the user to remain upright, operate from the still decked section, propel body weight towards the still-decked section, and have the capacity to completely dislodge one board per application of the device.

In accordance with the foregoing objects, the present invention is a versatile lever-type decking and plank removal tool of simple, inexpensive and extremely rugged construction for efficiently prying deck floor-boards from deck foundations and floor-joists to which they are nailed. The decking and plank removal tool will tear off any deck board in any configuration in seconds by significantly multiplying user effort, and allow the user to remain completely upright for the entire process. The decking and plank removal tool generally comprises an elongated four-foot handle having a circular cross-section at the user-end and a rectilinear cross-section at the opposing end. A demolition head is fixedly bolted to the rectilinear portion at the opposing end of the handle. The demolition head further comprises three components all formed of strips of 4140 high tensile steel, the three components being welded together in a uniquely functional and distinctly indestructible unitary configuration as follows. A heel member is formed by bending a strip of high tensile steel at two right angles to form a receptacle conforming to the opposing sides of the rectilinear portion of the handle. The heel member is attached to the handle and forms a protective/reinforcing shroud extending down over a 16" length at the front of the handle, around the distal end of the handle, and up a 6" length at the rear of the handle. A hook member protrudes outward from the heel member at the distal end of the handle perpendicular to the axis of the handle. The hook member hooks back inwardly and downward from the handle to form a three-sided receptacle conforming to the edge of the decking boards. Thus, the hook member hooks underneath the leading edge of each decking board with the distal end of the handle substantially centered atop the deck board. A reinforcing rib spans the protruding hook member and the heel member and joins them in a triangular configuration to provide ample reinforcement against the forces encountered during demolition.

The foregoing design in combination with other design details to be described result in a most effective, rugged and reliable decking and plank removal tool that speeds removal of deck boards and minimizes damage. In addition, the device may be scaled in size to remove smaller or larger boards and planks, such as hardwood flooring or docks.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

The present invention is an improved decking and plank removal tool for efficiently prying floor-boards from deck foundations and floor-joists to which they are nailed. The decking and plank removal tool will tear off any deck board in any configuration in seconds with a minimum of effort, allowing the user to remain completely upright for the entire process. Moreover, it has a simple, inexpensive and extremely rugged design.

Figure 1:
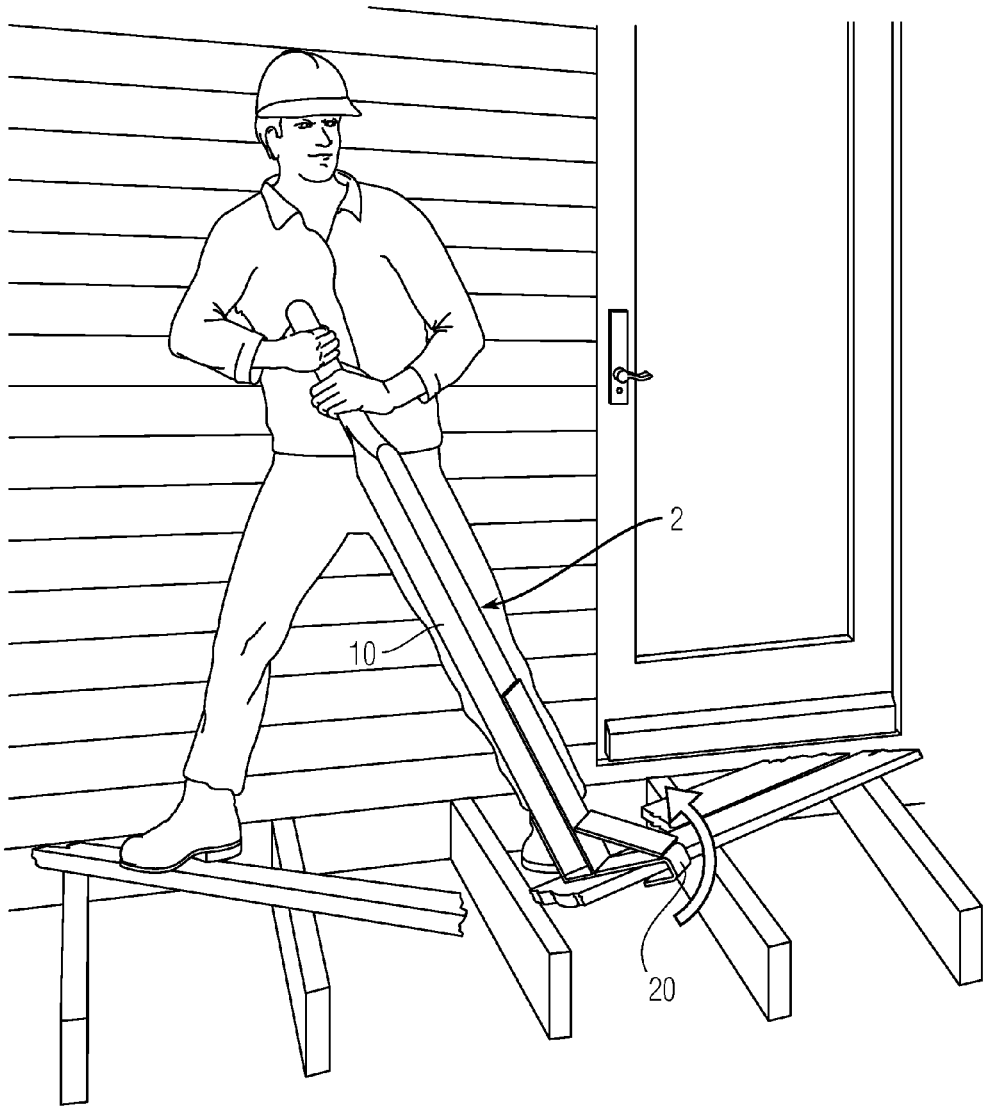
FIG. 1 is a perspective illustration of a deck board pulling tool 2 according to the present invention in use.

FIG. 1 is a perspective illustration of a deck board pulling tool 2 according to the present invention in use, which illustrates two significant advantages to the present design. As described above, a conventional pry bar (crowbar) would be necessarily wedged into the slot at the inside edge (I) of the deck board to be removed. This is because a pry bar needs a supporting structure (the next adjacent deck board) for leverage. Then when levered, a large component of the pry bar force is imparted into the plane of the deck board and does not facilitate removal of the nails at all, but usually succeeds in shattering the deck board. The present invention is self-supporting and does not need any supporting structure (e.g., the next adjacent deck board) for leverage. The tool 2 includes a handle 10 with a unique demolition head 20 fixedly attached to a rectilinear portion of the handle 10. The head 20 hooks around the outside edge (O) of each deck board to be removed, and the user levers (pulls) the tool 2 toward himself. The flat distal base of the handle 10 abuts the inside edge (I) of the deck board and holds it down. The next adjacent deck board serves as a fulcrum. As the pulling tool 2 hooks overtop the outside (O) of the deck board, with the base of the handle 10 holding down the deck board and the next adjacent deck board serving as a fulcrum, the inwardly-hooked configuration of demolition head 20 pulls the outside (O) of the deck board directly up, vertically, along the axis of the nails. With no lateral forces the nails release more easily. Moreover, the angular configuration of the present invention affords full 90 degree leverage during the prying operation which fully dislodges 3" nails from the foundation joists below. Consequently, a user need only pry each board once. The increased efficiency allows a normal user to demolish a 300 square foot deck surface in less than ten minutes as opposed to the several hours it might take to complete this work with a conventional pry bar.

Figure 2:
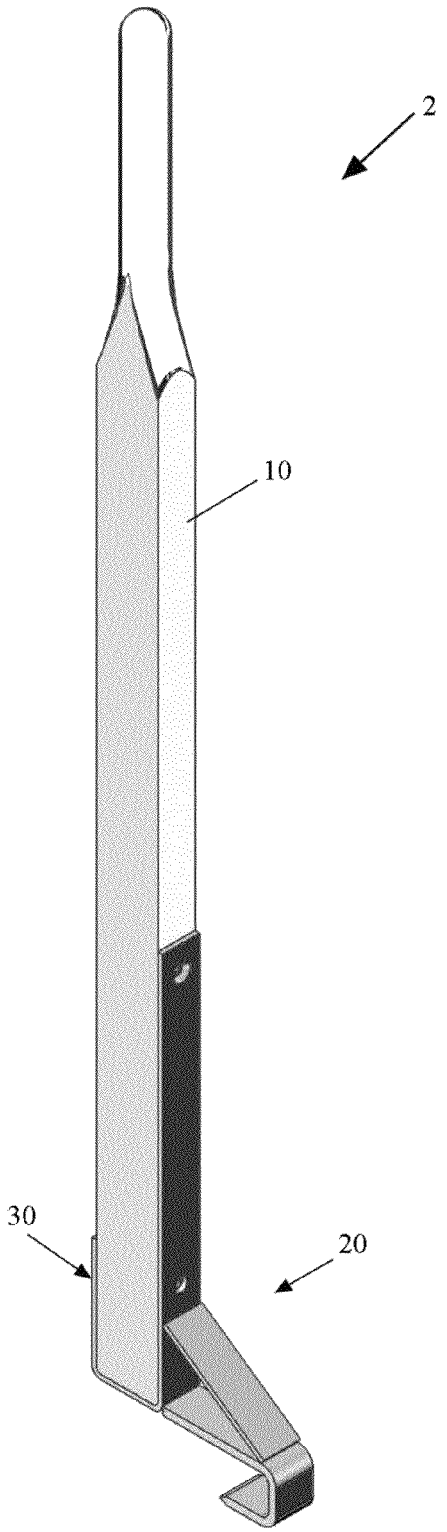
FIG. 2 is a perspective illustration of a deck board pulling tool 2 as in FIG. 1.
Figure 3:
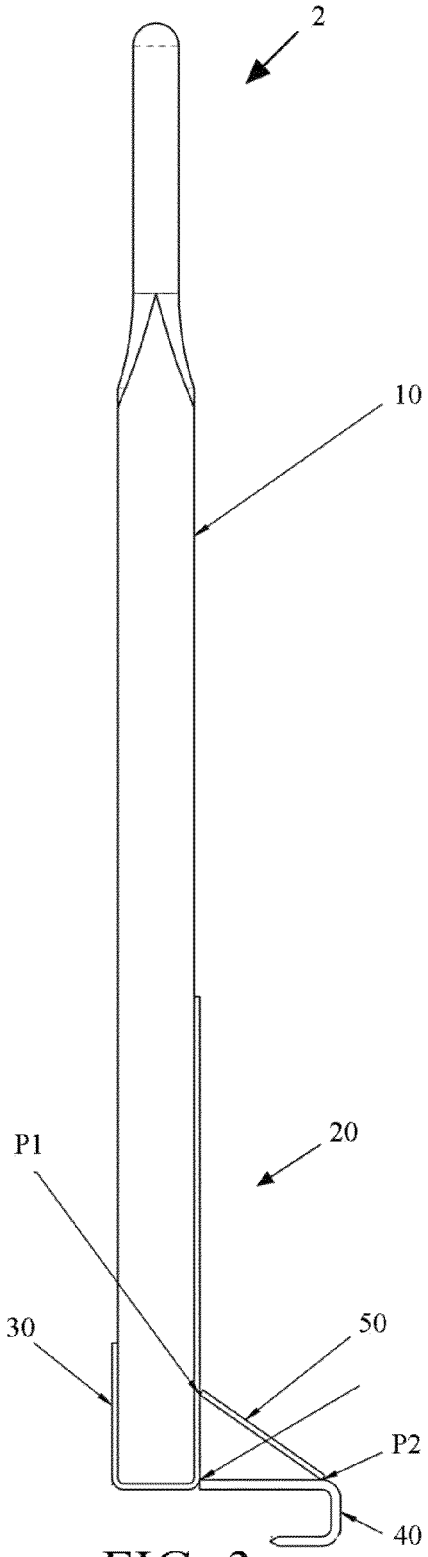
FIG. 3 is a side view of a deck board pulling tool 2 as in FIGS. 1-2.

With combined reference to FIGS. 2-3, the deck board pulling tool 2 further comprises an elongate handle 10, preferably four feet in length formed from a 1.5" by 2.5" rectilinear (here rectangular) bamboo blank with a rounded grip end (at top) preferably machined into a circular cross-section along approximately a 9" length. The choice of bamboo is important inasmuch as bamboo has a greater tensile strength than steel by density. The handle 10 retains its 1.5" by 2.5" rectilinear cross-section at the opposing end, where the demolition head 20 is fixedly bolted.

To achieve the advantages described above and exemplified in FIG. 1, the demolition head 20 generally comprises an inverted-hook configuration offset forwardly from the axis of the handle 10 and turned inward and downward from the base of the handle 10. This inverted-hook configuration pulls the outside (O) of the deck board directly up, vertically, along the axis of the nails, using the base of the handle 10 as an anchor. In the illustrated embodiment, the inverted hook configuration of the demolition head 20 is achieved most economically with three components welded together, each of which in turn are cold-formed of strips of 4140 high tensile steel.

Figure 6:
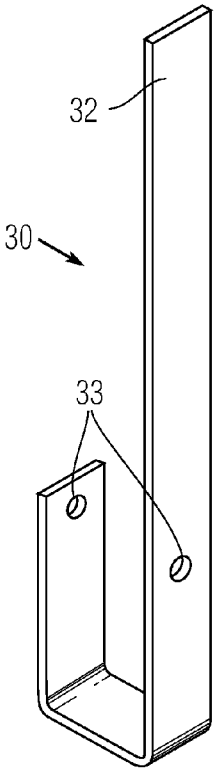
FIG. 6 is a side view of the heel member 30 of the deck board pulling tool 2 of FIGS. 1-3.
Figure 7:
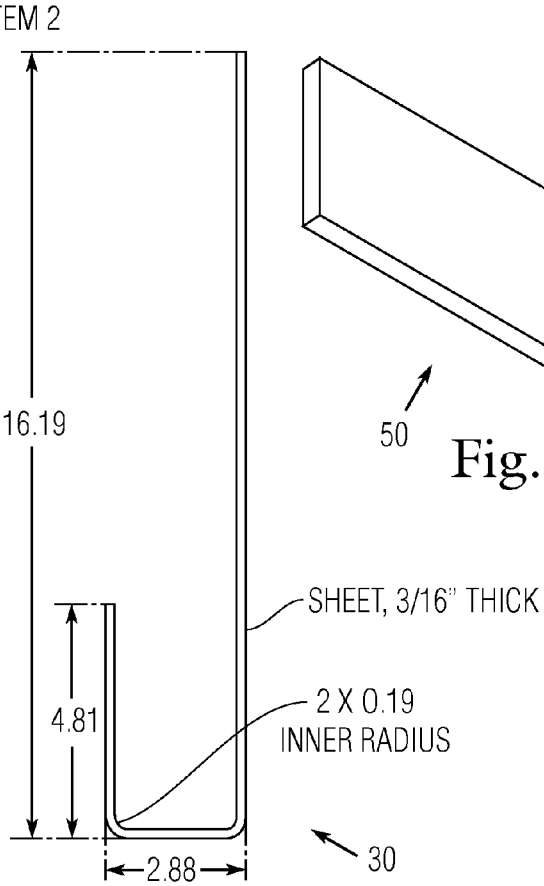
FIG. 7 is a front view of the heel member 30 of FIG. 6.

More specifically, a heel member 30 is formed by bending a two foot strip of 1.5"×3/16" high tensile steel at two right angles to form a receptacle generally conforming to the opposing sides of the rectilinear portion of the handle. The right-angle bends are juxtaposed and spaced 2.88" apart. With combined reference to FIGS. 6 and 7, the two right-angle bends are offset 5.71" from center such that the heel member 30 is attached to the handle 10 and forms a protective/reinforcing shroud completely covering the base of handle 10 along at least a 12" length, and covering an opposing side of the rectilinear portion of said handle 10 along at least a 4" length. More preferably, heel member 30 extends contiguously down over an approximate 16" length at the front of the handle 10, 2.88" around the base of the handle 10, and up a 4.8" length at the rear of the handle 10.

Heel member 30 is defined by a plurality of countersunk holes 32, 33 by which it is bolted to the handle 10. One pair of countersunk holes 33 face each other evenly on each side of the heel member 30 and allows a through-bolt to pass through the heel member twice, once on each side of the rectilinear section of the handle 10, the bolt passing entirely through the handle 10 at about a 4.2" offset from the flat base of the handle 10. The other singular hole 32 is spaced upward along the heel member 30 approximately 12" from holes 33 to allow a through-bolt to pass through the heel member 30 once, effectively anchoring the heel member 30 to the handle 10 further up along the handle, and on the opposite side of the hook member 40, thereby increasing stability despite the heavy torque. All holes 32, 33 are countersunk to recess the heads/nut of the bolts passing there through, ensuring a flush fit and smooth, safe surfaces.

Referring back to FIGS. 2-3, a hook member 40 is attached to and protrudes outward from the heel member 30 at the distal end of the handle 10, initially extending perpendicular to the axis of the handle 10. The hook member 40 hooks back inwardly and downward from the base of handle 10 to form a three-sided receptacle conforming to the edge of the decking boards. The three-sided angular U-shaped receptacle extends downward from and opens inward toward the base of handle 10, and is offset from the base so that the handle 10 pins the inside (I) of the deck board while the hook member 40 lifts the outside (O) of the deck board directly up.

Figure 4:
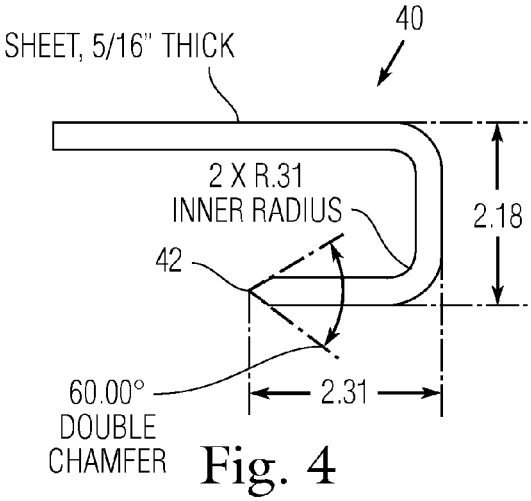
FIG. 4 is a side view of the hook member 20 of the deck board pulling tool 2 of FIGS. 1-3.
Figure 5:
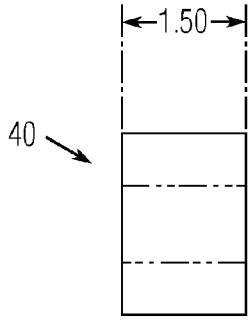
FIG. 5 is a front view of the hook member 20 of FIG. 4.

With combined reference to FIGS. 4-5, hook member 40 is formed by bending a seven-inch strip of 1.5"×5/16" high tensile steel at two right angles to form a hook generally conforming to the edges of a decking board. The right-angle bends are spaced 2.18" apart, and offset to form a longer top than bottom section. The top section is equal in length to the 2.88" length of heel member 30 and is designed to be welded thereto. The hook member 40 hooks back inwardly and downward to a 2.31" beveled tip which is preferably double-chamfered at two approximately 60 degree chamfers to form the beveled edge 42. The chamfered edge 42 helps insert the hook member 40 and seat it underneath the leading edge of each decking board with the user holding the handle 10 substantially diagonal to the deck board, the base of handle 10 resting atop the deck board.

Figure 8:
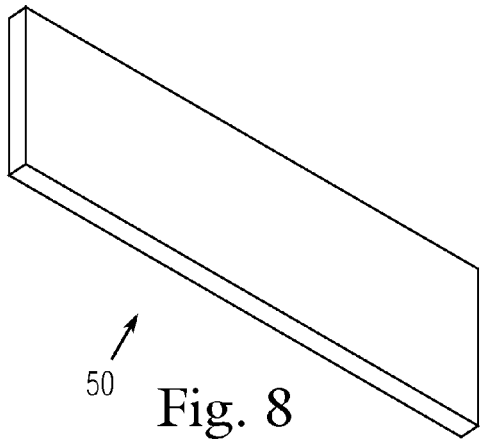
FIG. 8 is a perspective view of the reinforcing rib 40 of the deck board pulling tool 2 of FIGS. 1-3.

As seen in FIG. 8, a reinforcing rib 50 spans the protruding hook member 40 and the heel member 30 and joins them in a right-triangular configuration as shown to provide reinforcement against the forces encountered during demolition. Reinforcing rib 50 is a straight 4.88" inch strip of 1.5"×3/16" high tensile steel. As best seen in FIG. 3, reinforcing rib 50 is welded end-to-end between a point P1 approximately 3.5" upward along the 16" length of heel member 30 at the front of the handle 10, to a point P2 located at the upper right-angle bend of hook member 40. Reinforcing rib 50 thereby forms a structural right-triangle between the protruding hook member 40 and the heel member 30, and supports the hook member against the excessive torque loads experienced.

The foregoing design in combination with other design details to be described result in a most effective, rugged and reliable decking and plank removal tool that speeds removal of deck boards and minimizes damage to the boards being removed and to the underlying structural members. Given the four foot handle 10 disclosed, the device amplifies a user's horizontal pulling force into a seven-fold increase, and translates it into a vertical pulling force directed upward directly along the nails of the deck board. If a user can pull with a 300 lb. force, the deck board is torqued upward by a two-ton force. It becomes possible to demolish a 300 square foot deck in less than 10 minutes. Moreover, the device's design allows 100% of the removal force to be selectively applied directly at a single nail, nail by nail, one at a time. Given its extended range of motion, the device can continuously apply full force to each fastener one-by-one, the force shifting as each preceding fastener fails.

In addition to the foregoing, the device may be scaled in size to remove smaller boards and planks, such as hardwood flooring.

Those skilled in the art will understand that various modifications and variations can be made in the present invention without departing from the spirit or scope of the invention. It is to be understood, therefore, that the invention may be practiced otherwise than as specifically set forth in the appended claims.

What is claimed is:

1. A lever-type decking and plank removal tool for prying deck boards from underlying joists to which they are nailed, comprising:

an elongate handle having a rounded cross-section at one end and extending lengthwise along a portion of said handle, and a rectilinear cross-section extending lengthwise from said rounded cross-section to a flat base of said handle; and a demolition head fixedly attached to the rectilinear portion of said handle, said demolition head further comprising, a heel member contiguously conforming to the rectilinear section of said handle along at least two opposing sides and angled inward along said base, a hook member joined to said heel member and protruding outward therefrom perpendicular to said handle to an angular hook offset from said handle, said hook being defined by an angular U-shaped receptacle for gripping an edge of a deck board, the U-shaped receptacle extending downward from and opening inward toward said base, a reinforcing rib attached to said heel member and to said hook member and defining a right triangle therewith; and at least one bolt passing through said heel member twice on each side of said handle and passing entirely through said handle.

2. The lever-type decking and plank removal tool according to claim 1, wherein said heel member is formed from a strip of steel bent at two juxtaposed right angles to contiguously conform to the rectilinear section of said handle along two opposing sides and along said base.

3. The lever-type decking and plank removal tool according to claim 1, wherein said hook member is formed from a strip of steel bent at two juxtaposed right angles to form said angular U-shaped receptacle for gripping an edge of a deck board.

4. The lever-type decking and plank removal tool according to claim 3, wherein said hook member extends to a beveled distal edge.

5. The lever-type decking and plank removal tool according to claim 4, wherein the beveled distal edge of said hook member is double-beveled.

6. The lever-type decking and plank removal tool according to claim 1, wherein the juxtaposed right angles of said hook member are offset at least four inches from said base.

7. The lever-type decking and plank removal tool according to claim 1, wherein said at least one bolt comprises a pair of bolts including a first bolt passing through said heel member twice on each side of said handle and passing entirely through said handle, and a second bolt passing through said heel member once on one side of said handle and passing entirely through said handle.

8. The lever-type decking and plank removal tool according to claim 7, wherein said heel member is machined with countersunk holes for flush seating of said first and second bolts.

9. The lever-type decking and plank removal tool according to claim 1, wherein said handle is formed of bamboo.

10. The lever-type decking and plank removal tool according to claim 1, wherein said heel member, hook member and reinforcing strip are all formed of strips of 4140 high tensile steel.

11. The lever-type decking and plank removal tool according to claim 1, wherein said heel member is formed of a strip of 3/16" thick steel.

12. The lever-type decking and plank removal tool according to claim 11, wherein said hook member is formed of a strip of 5/16" thick steel.

13. The lever-type decking and plank removal tool according to claim 1, wherein said heel member completely covers the handle base, one side of the rectilinear portion of said handle along at least a 12" length, and an opposing side of the rectilinear portion of said handle along at least a 4" length.

14. A lever-type decking and plank removal tool for prying deck boards, comprising: an elongate handle having a rectilinear cross-section extending lengthwise along at least a partial length of said handle to a flat base; and a demolition head fixedly attached to the rectilinear portion of said handle, said demolition head further comprising a heel member formed from a metal strip bent at two juxtaposed right angles to contiguously conform to the rectilinear section of said handle along two opposing sides and along said base, a hook member formed from a strip of steel protruding perpendicularly from said handle at said base and joined to said heel member, said hook member protruding outward to two juxtaposed right angles defining an angular receptacle for gripping an edge of a deck board, and a reinforcing rib attached between said heel member and said hook member; and at least one bolt attaching said heel member to said handle.

15. The lever-type decking and plank removal tool according to claim 14, wherein said hook member extends to a beveled distal edge.

16. The lever-type decking and plank removal tool according to claim 14, wherein the beveled distal edge of said hook member is double-chamfered.

17. The lever-type decking and plank removal tool according to claim 14, wherein said at least one bolt comprises a pair of bolts including a first bolt passing through said heel member twice on each side of said handle and passing entirely through said handle, and a second bolt passing through said heel member once on one side of said handle and passing entirely through said handle.

18. The lever-type decking and plank removal tool according to claim 17, wherein said heel member is machined with countersunk holes for flush seating of said first and second bolts.

19. The lever-type decking and plank removal tool according to claim 1, wherein said handle is formed of bamboo.

* * * * *